US012262859B2

(12) United States Patent
Heo et al.

(10) Patent No.: US 12,262,859 B2
(45) Date of Patent: Apr. 1, 2025

(54) DISHWASHER

(71) Applicant: LG Electronics Inc., Seoul (KR)

(72) Inventors: Nam Kwon Heo, Seoul (KR); Dong Hwi Park, Seoul (KR)

(73) Assignee: LG Electronics Inc., Seoul (KR)

( * ) Notice: Subject to any disclaimer, the term of this patent is extended or adjusted under 35 U.S.C. 154(b) by 200 days.

(21) Appl. No.: 17/959,639

(22) Filed: Oct. 4, 2022

(65) Prior Publication Data

US 2023/0130490 A1 Apr. 27, 2023

(30) Foreign Application Priority Data

Oct. 27, 2021 (KR) ..... 10-2021-0144542

(51) Int. Cl.
*A47L 15/50* (2006.01)

(52) U.S. Cl.
CPC ..... *A47L 15/503* (2013.01)

(58) Field of Classification Search
CPC ..... A47L 15/50; A47L 15/501; A47L 15/502; A47L 15/503; A47L 15/505; A47L 19/04
See application file for complete search history.

(56) References Cited

U.S. PATENT DOCUMENTS 5,205,419 A 4/1993 Purtilo
5,351,837 A * 10/1994 Smith ..... A47L 15/503 312/311
6,546,942 B2 * 4/2003 Smith ..... A47L 15/505 134/201
7,231,929 B2 * 6/2007 Landsiedel ..... A47L 15/503 134/201
7,644,826 B2 1/2010 Koch et al.
7,766,175 B2 * 8/2010 Jadhav ..... A47L 15/505 211/41.9
7,984,812 B2 * 7/2011 Pike ..... A47L 15/503 211/41.9
8,042,559 B2 * 10/2011 Choi ..... B08B 3/04 211/41.9
8,651,287 B2 * 2/2014 Moser ..... A47L 15/503 211/195
8,985,375 B2 * 3/2015 Kohles ..... A47L 15/503 211/41.9
9,949,613 B2 * 4/2018 Blanchard ..... A47L 15/50
11,317,740 B2 * 5/2022 Roberts ..... A47B 57/581
(Continued)

FOREIGN PATENT DOCUMENTS

DE 102006055346 A1 5/2008
DE 102009002270 A1 10/2010
(Continued)

OTHER PUBLICATIONS

European Search Report in European Appln. No. 22200248.7, dated Mar. 2, 2023, 9 pages.

*Primary Examiner* — Patrick D Hawn
(74) *Attorney, Agent, or Firm* — Fish & Richardson P.C.

(57) ABSTRACT

A dishwasher includes a storage rack. The storage rack includes a frame defining a storage space of a washing target; a side rack disposed to be rotatable with respect to the frame and configured to support the washing target; and a holder coupled to the frame and configured to guide the rotation of the side rack. The side rack can maintain a posture in which the side rack supported by the holder is inclined at a preset angle with respect to the holder.

16 Claims, 14 Drawing Sheets

(56) References Cited

U.S. PATENT DOCUMENTS

| | | | | |
|---|---|---|---|---|
| 11,612,300 | B2 * | 3/2023 | Harr | A47L 15/505 211/41.8 |
| 11,642,002 | B1 * | 5/2023 | Tanpure | A47L 15/503 211/41.8 |
| 11,826,004 | B2 * | 11/2023 | Reiter | A47L 15/503 |
| 2005/0109378 | A1 * | 5/2005 | Landsiedel | A47L 15/14 134/179 |
| 2008/0272073 | A1 | 11/2008 | Pike et al. | |
| 2009/0120883 | A1 | 5/2009 | Jadhav et al. | |
| 2012/0056519 | A1 * | 3/2012 | Woo | A47L 15/503 312/228.1 |
| 2020/0329947 | A1 * | 10/2020 | Clerkin | A47L 15/4278 |

FOREIGN PATENT DOCUMENTS

| | | | | | |
|---|---|---|---|---|---|
| KR | 20050105717 | A | * | 11/2005 | |
| KR | 20210062822 | A | * | 6/2021 | A47L 15/505 |
| WO | WO-2022055011 | A1 | * | 3/2022 | |
| WO | WO-2023027506 | A1 | * | 3/2023 | |

* cited by examiner

DISHWASHER

CROSS-REFERENCE TO RELATED APPLICATION

This application claims priority to and benefit of Korean Patent Application No. 10-2021-0144542 filed on Oct. 27, 2021, which is hereby incorporated by reference as if fully set forth herein.

TECHNICAL FIELD

The present disclosure relates to a dishwasher, more particularly, a dishwasher including a storage rack configured to receive various dishes.

BACKGROUND

Details in the background section do not constitute the related art but are given only as background information concerning the subject matter of the present disclosure.

A dishwasher is a home appliance configured to wash off contaminants such as food scraps or waste on dishes or cooking utensils by high-pressure wash water sprayed from a spray arm.

Such a dishwasher may wash dishes in an inner space defined in a tub. A front of the tub is open so that a user can put or take dishes in or out of the tub. A door is coupled to the front of the tub to close the inner space of the tub airtight if necessary.

At least one rack may be provided in the inner space of the tub and dishes may be held in various positions and in various postures in the rack.

In the rack, dishes and cooking utensils with various sizes and weights may be stored in a relatively small space of the rack. Accordingly, there is a need for a rack having a new structure configured to improve space utilization and user convenience at the same time.

The conventional rack may include a side rack to receive a washing target with a relatively large volume. The side rack may be rotatable with respect to the storage rack.

The side rack needs to have a structure configured to increase the storage efficiency of washing targets in the storage rack and secure the storage space.

In addition, since it is rotatable with respect to the storage rack, the side rack may be impacted by the wash water sprayed during a washing process and move. Due to the movement of the side rack, noise might occur or an impact might be applied to the washing target stored in the rack.

In addition, Due to the movement of the side rack, inconvenience might occur when the user stores the washing target in the storage rack or moves the storage rack in the washing space.

Therefore, a solution to the disadvantages described above is required.

SUMMARY

One objective of the present disclosure is to provide a dishwasher including a storage rack having a structure configured to improve space utilization and user convenience.

A further object of the present disclosure is to provide a dishwasher including a storage rack configured for a side rack to maintain a preset posture.

A still further object of the present disclosure is to provide a dishwasher including a side rack configured to provide convenience when a user handles the side rack.

Aspects according to the present disclosure are not limited to the above ones, and other aspects and advantages that are not mentioned above can be clearly understood from the following description and can be more clearly understood from the embodiments set forth herein.

A dishwasher according to an embodiment may include a storage rack. The storage rack may be detachably provided in the dishwasher and receive a dish as a washing target. The storage rack according to the embodiment may include a frame, a side rack and a holder.

The frame may define a storage space of a dish as a washing target and include a wire, a rib, a handle and a tine. The frame may include a mesh formed by combining a plurality of wires intersecting each other.

The side rack may be disposed to be rotatable with respect to the frame and configured to support the washing target. The side rack is rotatable in the rack and the side rack may support a relatively large dish, thereby reducing the space for receiving large dishes in the rack.

The holder may be coupled to the frame and configured to guide the rotation of the side rack. The holder may be formed of a plastic material by injection molding, as one example. The holder may be coupled to the wire.

The side rack may include a support bar, a side bar, a cross arm and an auxiliary support portion.

The side rack may be configured to maintain a posture in which the side rack supported by the holder is inclined at a preset angle with respect to the holder.

The holder may include a first holder and a second holder. The first holder may have one end of the cross arm to be rotatably coupled thereto and configured to maintain the posture of the side rack. The second holder spaced a preset distance apart from the first holder in the first direction, and the second holder may have the other end of the cross arm to be rotatably coupled thereto.

The first holder may maintain the inclined angle of the side rack with respect to the holder. Here, the cross arm may be freely rotatable with respect to the second holder.

The side arm may include a first part and a second part. The first part may have one end coupled to the support bar. The second part may be bent at the other end of the first part.

In the embodiment, when the second part becomes into contact with a stopper provided as one of the plurality of wires, the rotation of the side rack may be limited.

The cross arm may include a first piece, a second piece, a third piece and a fourth piece. The first to fourth pieces may be integrally formed with each other.

The first piece may have both ends coupled to the pair of side arms, respectively. A pair of second pieces may be bent from both ends of the first piece.

The pair of third pieces may be bent from one ends of the pair of first pieces, respectively, and rotatably coupled to the first holder and the second holder, respectively. The fourth piece may be bent from the third piece coupled to the first holder.

The first holder may include a first cell, a second cell and a third cell. The first to third cells may be integrally formed with each other by injection molding as one example.

The first cell may be secured to the wires. The second cell may be coupled to the first cell and the second cell may have the third piece to be rotatably secured thereto. Since the third piece is rotatable with respect to the second cell, the side rack may be rotatable with respect to the rack.

The third cell may be coupled to the first cell and the third cell may have the fourth piece to be rotatably secured thereto. The third cell may include a first guide pin, a second guide pin, a rotation limiter and a damper.

The first guide pin may be configured to guide the rotation of the fourth piece. The second guide pin may be spaced a preset distance apart from the first guide pin to define a rotation space in which the fourth piece is rotated, and configured to guide the rotation of the fourth piece.

The rotation limiter may be configured to connect one end of the first guide pin and one end of the second guide pin to each other, and limit the rotation of the fourth piece by contact with the fourth piece. The damper may protrude from the second guide pin and formed in the rotation space.

The second holder may include a third section, a second section and a third section. The first section may be secured to a portion at which the plurality of wires intersect each other. The second section may be coupled to the first section and penetrated by the wires. The third section coupled to the second section, the third section to which the third piece is rotatably coupled.

When the fourth piece is disposed in a first space formed between the rotation limiter and the damper, the side rack may maintain a first posture having a preset inclined angle with respect to the frame.

When the fourth piece is separated from the first space and the rotation of the second part is limited by the stopper, the side rack may maintain a second posture having a preset inclined angle with respect to the frame.

When the side rack maintains the second posture, the fourth piece may be in contact with the damper and the second part may be in contact with the stopper.

At least one of the fourth piece or the third cell may be elastically deformed by an external force applied to the side rack, to rotate the side rack to reach a new position from the current position.

A dishwasher according to an embodiment may include a storage rack. The storage rack may include a frame defining a storage space of a washing target; a side rack disposed to be rotatable with respect to the frame and configured to support the washing target; and a holder coupled to the frame and configured to guide the rotation of the side rack, and the side rack is configured to maintain a posture in which the side rack supported by the holder is inclined at a preset angle with respect to the holder.

In the dishwasher according to the present disclosure, the side rack may be disposed in the edge of the storage rack so that the side rack may be disposed in the position capable of minimizing interference with tines. In addition, even when the side rack is rotated at a certain angle, interference between the side rack and the plurality of tines disposed in the other portion of the rack may be minimized.

In addition, in the dishwasher according to the present disclosure, the side rack may maintain the first posture or the second posture during the washing process, even with an external force applied by the wash water sprayed during the washing process.

In addition, in the dishwasher according to the present disclosure, unless the user applies a relatively large external force, the side rack may maintain the first posture or the second posture. Accordingly, the posture of the side rack may not be changed by the wash water sprayed during the washing process.

Therefore, the side rack may be suppressed from moving or shaking by the wash water in the washing process, thereby effectively suppressing damage to dishes and noise generated by the moving and shaking of the side rack and enhancing user convenience and performance of the dishwasher.

Specific effects are described along with the above-described effects in the section of Detailed Description.

DESCRIPTION OF SPECIFIC EMBODIMENTS

Figure 1:
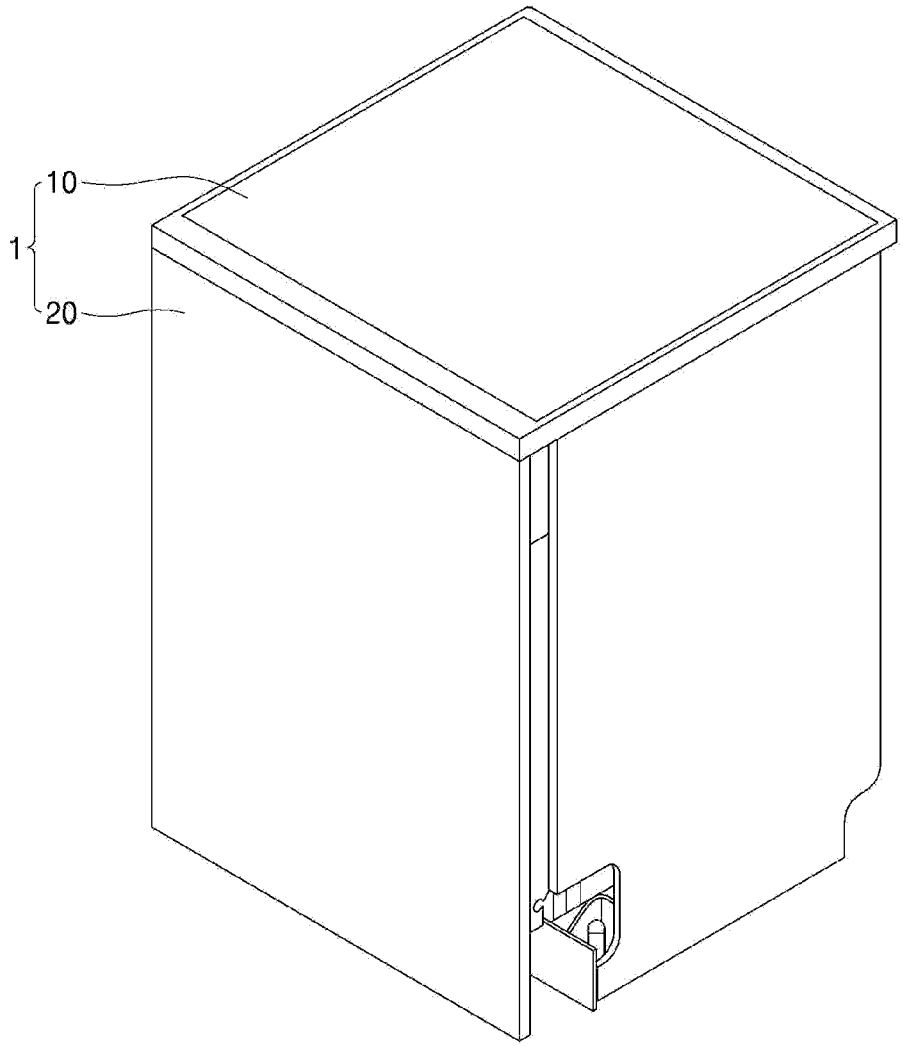
FIG. 1 is a perspective view showing an exterior design of a dishwasher according to an embodiment.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereinafter, a dishwasher 1 according to embodiments of the present disclosure will be described, referring to the accompanying drawings.

Figure 2:
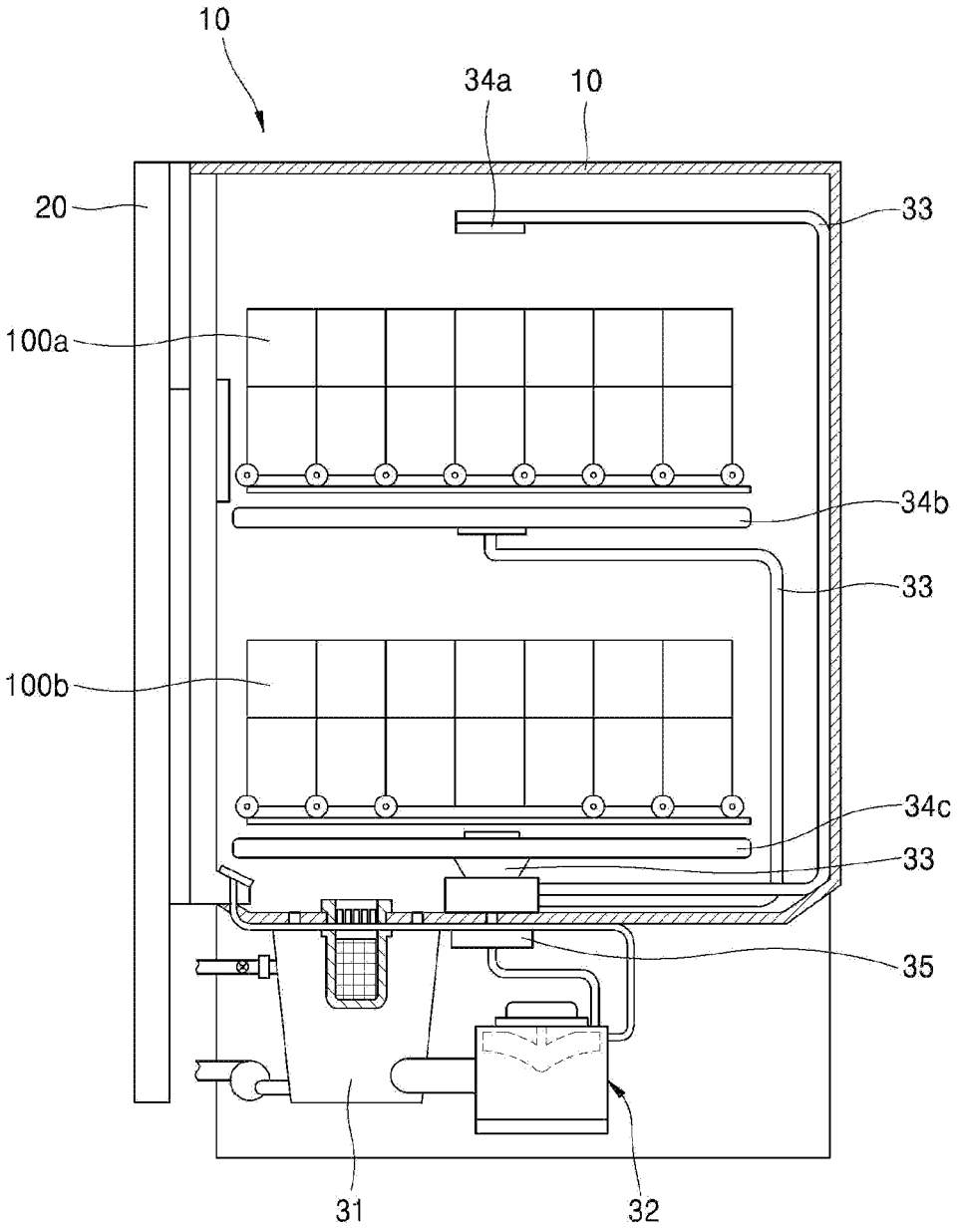
FIG. 2 is a schematically sectional view of a dishwasher according to an embodiment.

FIG. 1 is a perspective view showing an exterior design of a dishwasher 1 according to an embodiment. FIG. 2 is a schematically sectional view of a dishwasher 1 according to an embodiment. Referring to FIGS. 1 and 2, the entire configuration of the dishwasher 1 will be briefly described.

The dishwasher may be used in a certain space such as a kitchen as a built-in type. The dishwasher 1 according to the embodiment may include a tub 10 defining a predetermined space for washing dishes as washing targets and having an open front; a door 20 configured to open and close the open front; and a storage rack 100 disposed in the tub 10 and configured to store the dishes.

The dishwasher 1 according to the embodiment may include the tub having an open front and defining a washing room therein. The space for receiving dishes as the washing targets may be defined within the tub and the rack 100 may be provided in the tub. The dishwasher 1 may include a washing module configured to wash the stored dishes.

The dishwasher 1 may include the door rotatably coupled to the tub 10 and configured to open and close the open front of the tub 10. The door 20 may be rotatably coupled to one side of the tub 10, more specifically, rotatably coupled to upper and lower portions of the side of the tub.

The door 20 and the tub 10 may be hingedly connected. Specifically, the door may be rotatable with respect to a door rotation shaft disposed in a front end portion of the tub 10.

The dishwasher 1 may include a sump 31 disposed below the tub 10 and configured to temporarily store the wash water to be supplied to the tub 10. A filter for filtering foreign substances from the wash water drawn from the tub 10 may be provided in the sump 31.

The dishwasher 1 may include a water supply pipe for supplying wash water to the sump 31, a water supply valve for opening and closing the water supply pipe, and a water discharge pipe and a water discharge pump for discharging the wash water to the outside from the sump 31.

The dishwasher 1 may include a plurality of washing nozzle for spraying wash water into the washing room. The plurality of washing nozzles 34 may be configured to spray the wash water toward the rack 100 or an inner lateral surface of the tub 10.

A first washing nozzle 34*a* may be disposed in an upper portion of the tub and configured to spray wash water downward. A second washing nozzle 34*b* may be disposed below an upper rack 100*a* and configured to spray wash water toward the upper rack 100*a* located above, a third washing nozzle 34*c* may be disposed below a lower rack 1006 and configured to spray a lower rack 100*b* and configured to spray wash water toward the lower rack located above.

The dishwasher 1 may include a washing pump 32 disposed below the tub 10 and configured to pressurize the wash water stored in the sump 31 to the plurality of washing nozzles 34.

The dishwasher 1 may include a plurality of connection pipes 33 for guiding the wash water pressurized from the washing pump 32 to the washing nozzles 34.

The dishwasher 1 may include a switching valve 35 configured to selectively guide the wash water pressurizedly pumped from the washing pump 32 to the plurality of connection pipes 33.

The wash water supplied to the tub may be collected in the sump 31 disposed below the tub 10. The wash water collected in the sump 31 may be pressurized while flowing to the washing pump 32. The wash water pressurized in the washing pump 32 may flow to the switching valve 35 and selectively flow to the plurality of connection pipes 33. The wash water may be pressurizedly pumped to the washing nozzles 34 by flowing in the connection pipes 33.

The wash water pressurizedly pumped to the washing nozzles 34 may be sprayed to the tub 10 and re-collected in the sump 31 disposed below the tub 10.

A heater configured to heat the wash water may be further provided in the washing pump 32. The heater may generate steam by heating the wash water received in the washing pump 32.

The dishwasher 1 may further include a steam nozzle branched from the washing pump 32 and in communication with a predetermined portion of the tub 10. The generated steam may be sprayed to the tub 10 through the steam nozzle.

Hereinafter, a common structure of the upper and lower racks 100*a* and 100*b* will be described. Accordingly, the upper rack 100*a* and the lower rack 100*b* may be referred to as the rack 100 for clear description. The rack 100 will be described below.

Figure 3:
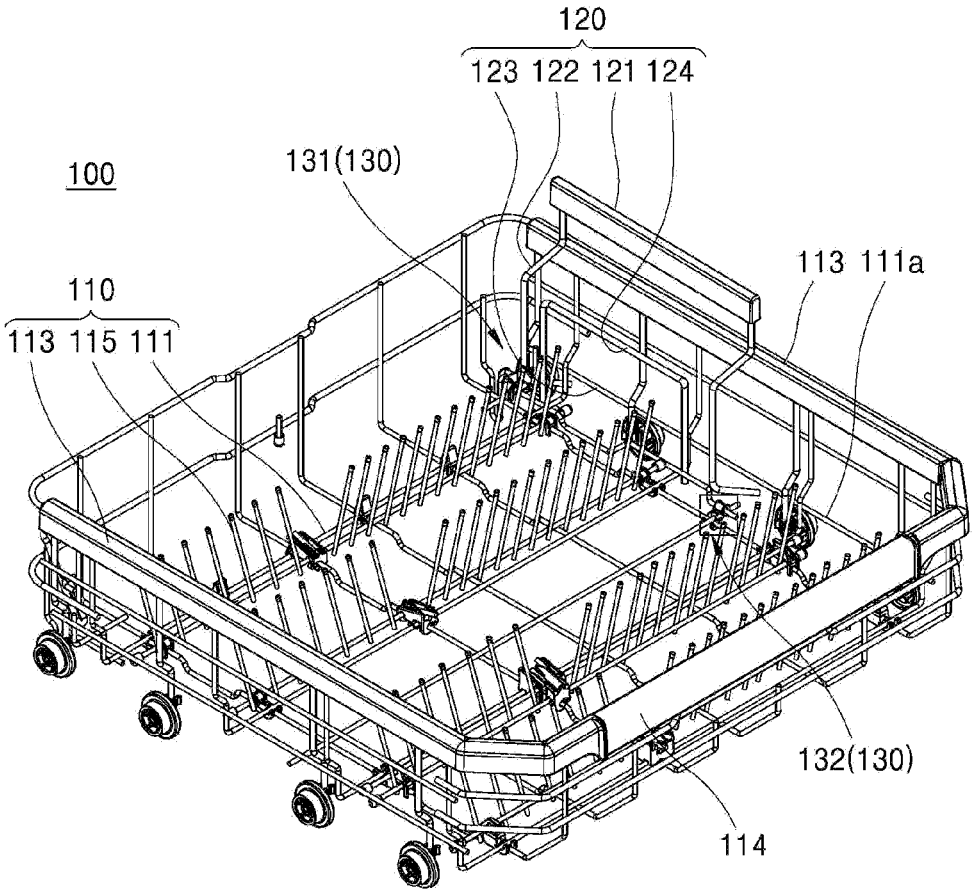
FIG. 3 is a perspective view showing a storage rack according to an embodiment.
Figure 4A:
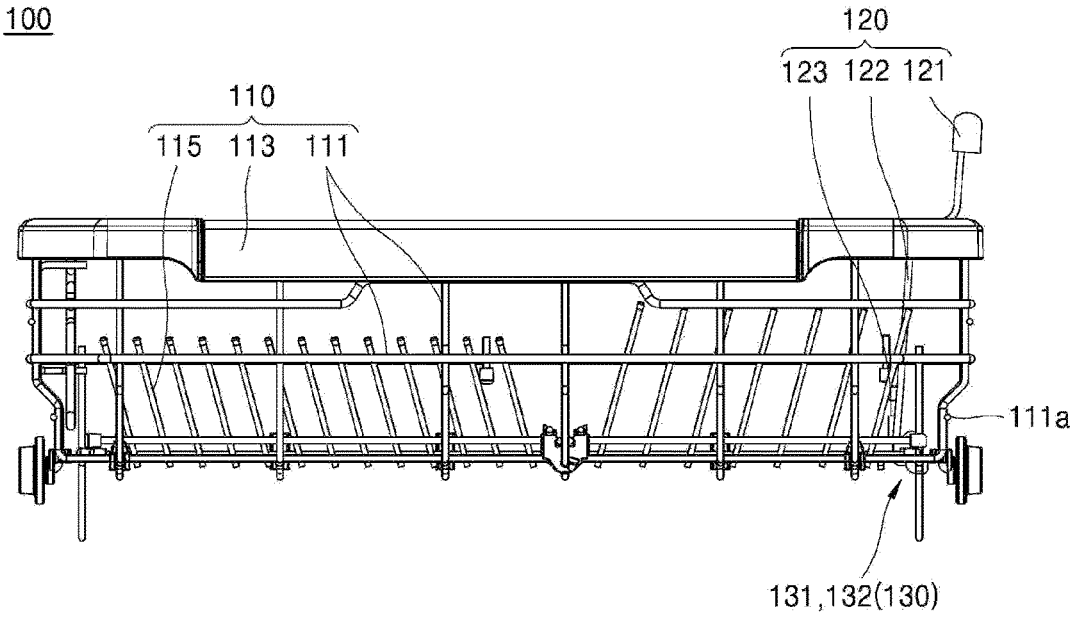
FIG. 4A is a front view showing a storage rack according to an embodiment.
Figure 4B:
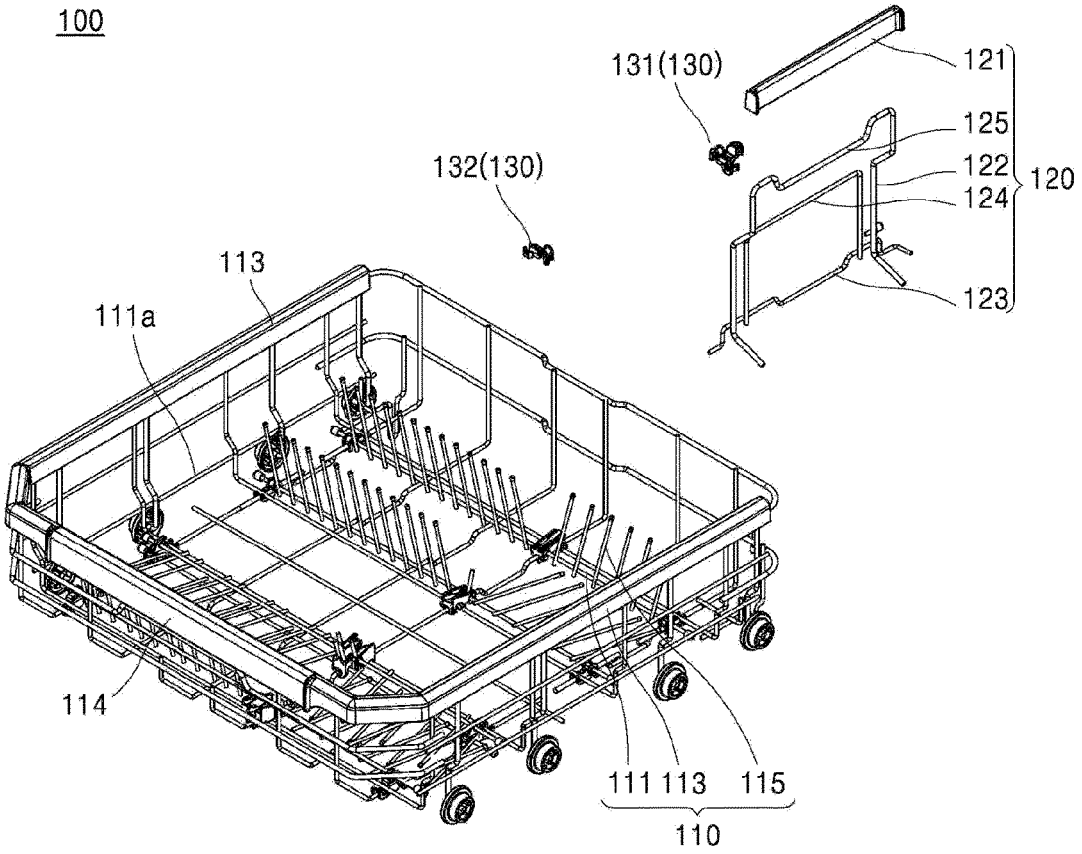
FIG. 4B is an exploded perspective view showing a storage rack according to an embodiment.
Figure 4C:
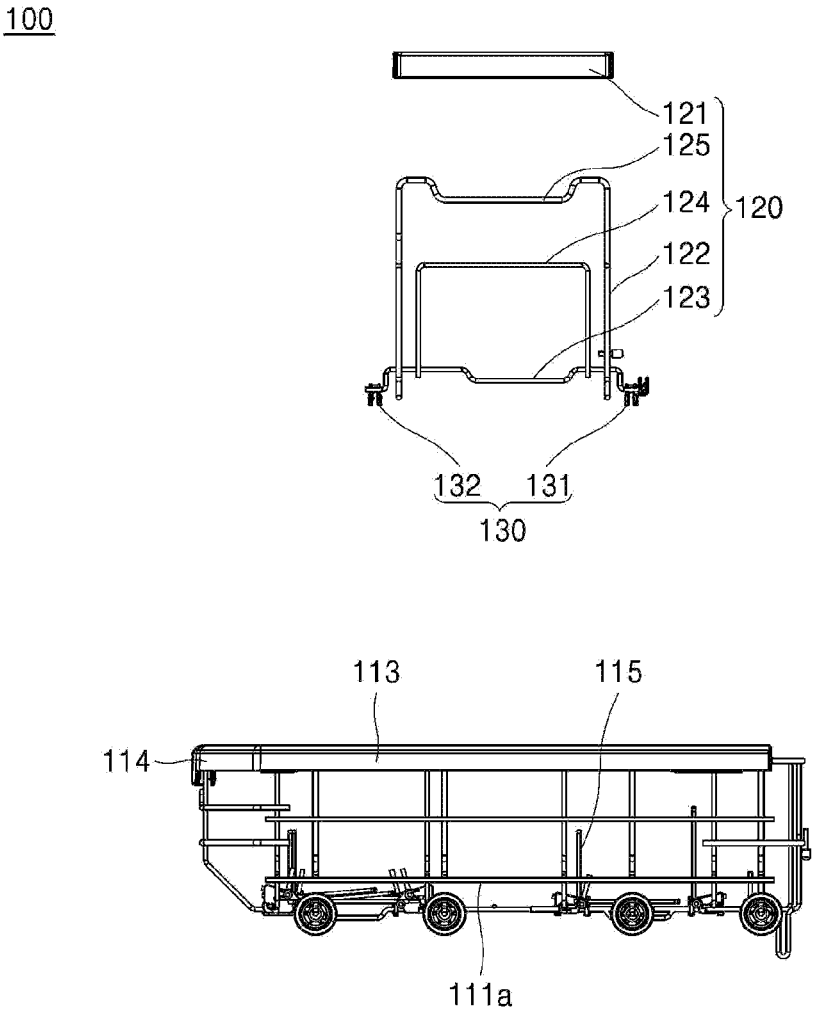
FIG. 4C is a view seen in another direction.

FIG. 3 is a perspective view showing the storage rack 100 according to an embodiment. FIG. 4A is a front view showing the storage rack according to an embodiment. FIG. 4B is an exploded perspective view showing the storage rack according to an embodiment. FIG. 4C is a view seen in another direction.

The storage rack 100 may be detachably provided in the dishwasher 1 and configured to receive dishes that are washing targets. The rack 100 according to the embodiment may include a frame 110, a side rack 120 and a holder 130.

The frame 110 may define a storage space for the dishes as washing targets. The frame 110 may include a wire 111, a rib 113, a handle 114 and a tine 115. The frame 110 may include a mesh made by a plurality of wires 111 coupled while crossing each other.

The wires 111 may be aligned in the rack 100 in a horizontal direction and a vertical direction, and a horizontal-direction wire 111 and a vertical-direction wire 111 may be coupled to cross each other, thereby forming the storage space. An edge portion of the wires 111 may be partially bent to form a 3-dimensional space for accommodating dishes in the rack 100.

The rib 113 may be disposed in both sides of the frame 110. Ends of at least some wires may be coupled to the ribs and the ribs may support the wires 111.

The handle 114 may be coupled to the rib 113 and configured to support the wires 111 together with the rib 113. The user may hold the handle 114 and move the rack 100 within the storage space. The handle 114 may be provided adjacent to the door 20 for opening and closing the washing space of the dishwasher 1, in a state of being secured to the rack 100.

The tine 115 may protrude on the wire 111 and the plurality of tines may be provided in the rack 100. The tine 115 may be used in conveniently placing dishes with various sizes and shapes in the rack 100.

The side rack 120 may be rotatable with respect to the frame 110 and configured to support washing targets. Since it is rotatably coupled in the rack 100, the size rack 120 may support relatively-large sized dishes. Accordingly, the space occupied by large-sized dishes may be reduced.

The holder 130 may be coupled to the frame 110 and configured to guide the rotational movement of the side rack 120. As one example, the holder 130 may be made of a plastic material and fabricated by injection-molding. The holder 130 may be coupled to the wire 111.

The size rack 120 may include a support bar 121, a side arm 122, a cross arm 123, an auxiliary support portion 124 and a securing arm 125.

The support arm 121 may has a longitudinal direction that is in parallel to a first direction of the storage rack 100, and may be configured to support washing targets. When the side rack 120 is used in supporting dishes, the support bar 121 may come into contact with the dishes and support some load of the dishes.

The side arm 122 may be provided as a pair coupled to both ends of the support bar 121. When being used to support the dishes, the side rack 122 may be configured to contact with the dishes and support some load of the dishes.

The support bar 121 may be rotated together with the rotation of the side arm 122 to move in a second direction intersecting the first direction. Dishes may be accommodated in the space defined between the support bar 121 and an edge portion of the frame 110.

The cross arm 123 may be coupled to the pair of the support bars 121 and both ends of the cross arm 123 may be rotatably secured to the holder 130. The cross arm 123 and the pair of the support bars 121 may be fixedly coupled to each other. The cross arm 123 may keep a preset distance between the pair of the support parts 121, and increase the structural strength of the side rack 120.

The auxiliary support portion 124 may have both ends coupled to the cross arm 123, and may be made of a linear member having a bent portion. The auxiliary support portion 124 may be formed in an inverted U-shape as a whole, and may be configured to support dishes. When the side rack 120 is used to support dishes, the auxiliary support portion 124 may support some load of the dishes by contacting with them.

The securing arm 125 may have both ends coupled to the pair of the side arms 122, respectively. The support bar 121 may be coupled to the securing arm 125. Here, the support bar 121 may forcibly secured to the securing arm 125 so that it may include a groove to be secured to the securing arm 125.

To stably maintain the coupling state between the support bar 121 and the securing arm 125, a bent portion may be formed in the securing arm 125 as shown in FIGS. 4B and 4C. Due to the bent portion of the securing arm 125, the support bar 121 may come into broad contact with the securing arm 125 to be stably supported by the securing arm 125.

Referring to FIGS. 3, 4A, 4B and 4C, the side rack 120 may be disposed in the edge portion of the frame 110, adjacent to a predetermined portion of the handle 114. At this time, the longitudinal direction of the side rack 120 may intersect that of the handle 114. In addition, the side rack 120 may be disposed adjacent to the rib 113 and the longitudinal direction of the side rack 120 may be parallel to that of the rib 113.

Since the side rack 120 is provided in the edge portion of the storage rack 100, interference with the tine from may be reduced. In addition, even if the side rack 120 is rotated at a certain angle, the interference between the side rack 120 and the plurality of tines 115 arranged in the other portion of the rack 100.

The side rack 120 supported by the holder 130 may maintain a posture of being tilted with respect to the holder 130. As one example, the side rack 120 may maintain a first posture ST1 (see FIG. 7) or a second posture ST2 (see FIG. 8), which will be described in detail later.

The holder 130 may include a first holder 131 and a second holder 132. The first holder 131 and the second holder 132 may have a relatively complex shape that facilitates shape-fitting and forcibly fitting to the wire 111.

In addition, the first holder 131 and the second holder 132 may be made of a material having high durability against wash water. In particular, when the side rack 120 changes its posture from the first posture ST1 to the second posture ST2 or vice versa, the first holder 131 could be elastically deformed, so it may be made of a material that is easy to elastically deform.

Accordingly, the first holder 131 and the second holder 132 may be fabricated by injection-molding a plastic material as one example.

The first holder may have one end of the cross arm 123 to be rotatably coupled thereto, and may keep the posture of the side rack 120, for example, the first posture ST1 or the second posture ST2. The second holder 132 may spaced a preset distance from the first holder 131 in the first direction, and may have the other end of the cross arm 123 to be rotatably coupled thereto.

The first holder 131 may be configured to maintain the inclined angle of the side rack 120 with respect to the holder 130 by pressurizing the cross arm 123. Here, the cross arm 123 may be coupled to the second holder to be freely rotatable.

The side arm 122 may include a first part 1221 and a second part 1222. The first part 1221 may have one end coupled to the support bar 121. The second part 1222 may be bent at the other end of the first part 1221.

In the embodiment, when the second part 1222 becomes into contact with a stopper 111*a* provided as one of the plurality of wires 111, the rotation of the side rack 120 may be restricted.

When the side arm 122 is rotated, the bent second part 1222 may become to contact with the wire 111 and the wire 111 in contact with the second part 1222 may serve as the stopper 111*a*. Due to this structure, the rotation angle of the side rack 120 with respect to the rack 100 may be restricted.

Figure 10A:
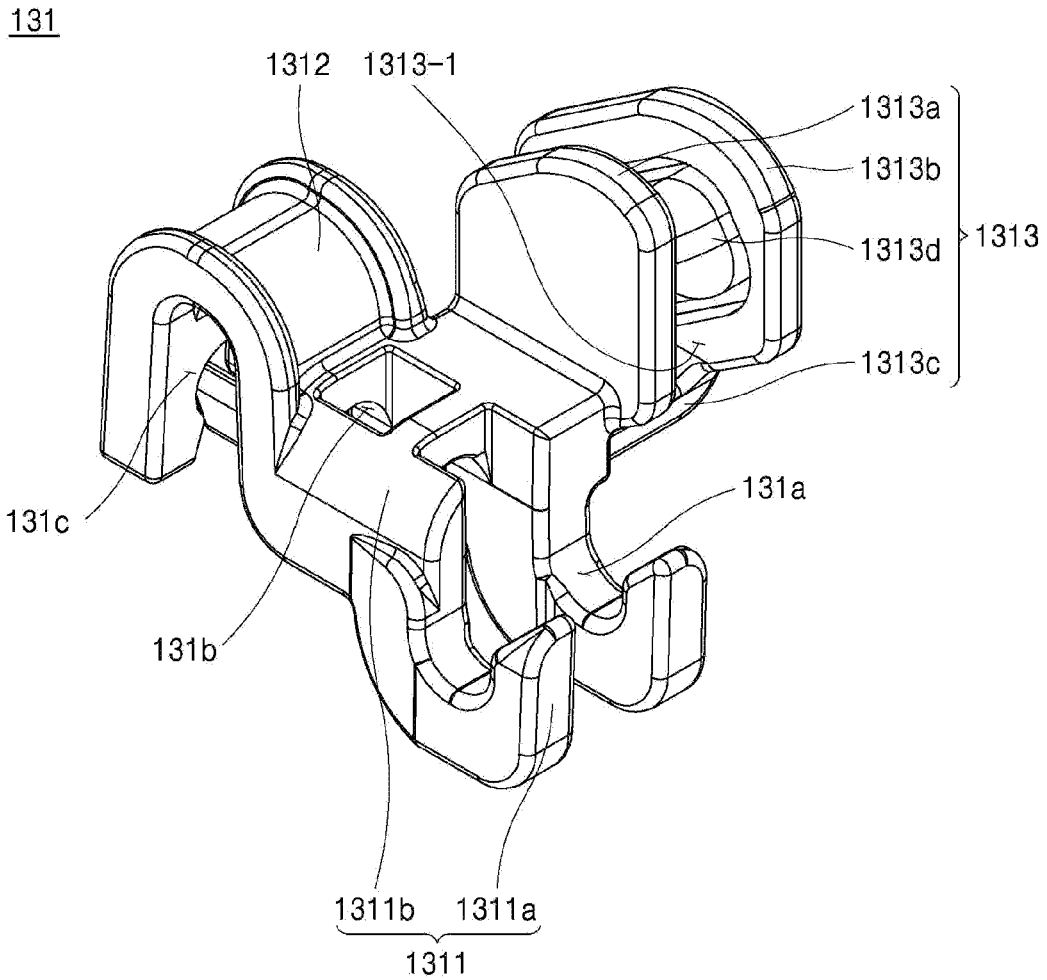
FIG. 10A is a perspective view showing a first holder according to an embodiment.
Figure 10B:
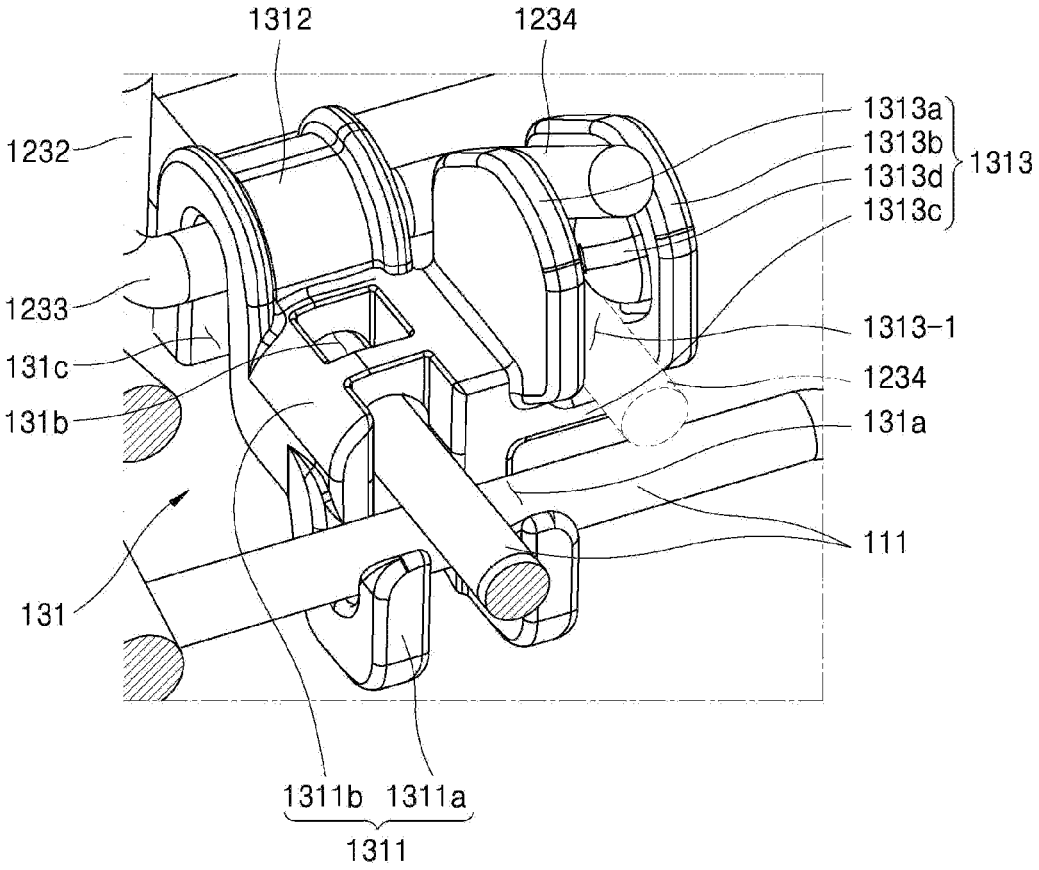
FIG. 10B is a partially enlarged perspective view of a portion where a first holder is coupled in a storage rack according to an embodiment.

Referring to FIGS. 10A and 10B, the structure of the cross arm 123 and the first holder 131 will be described first. FIG. 10A is a perspective view showing the first holder 131 according to the embodiment. FIG. 10B is a partially enlarged perspective view of a portion where the first holder 131 is coupled in the storage rack 100 according to the embodiment.

Figure 5:
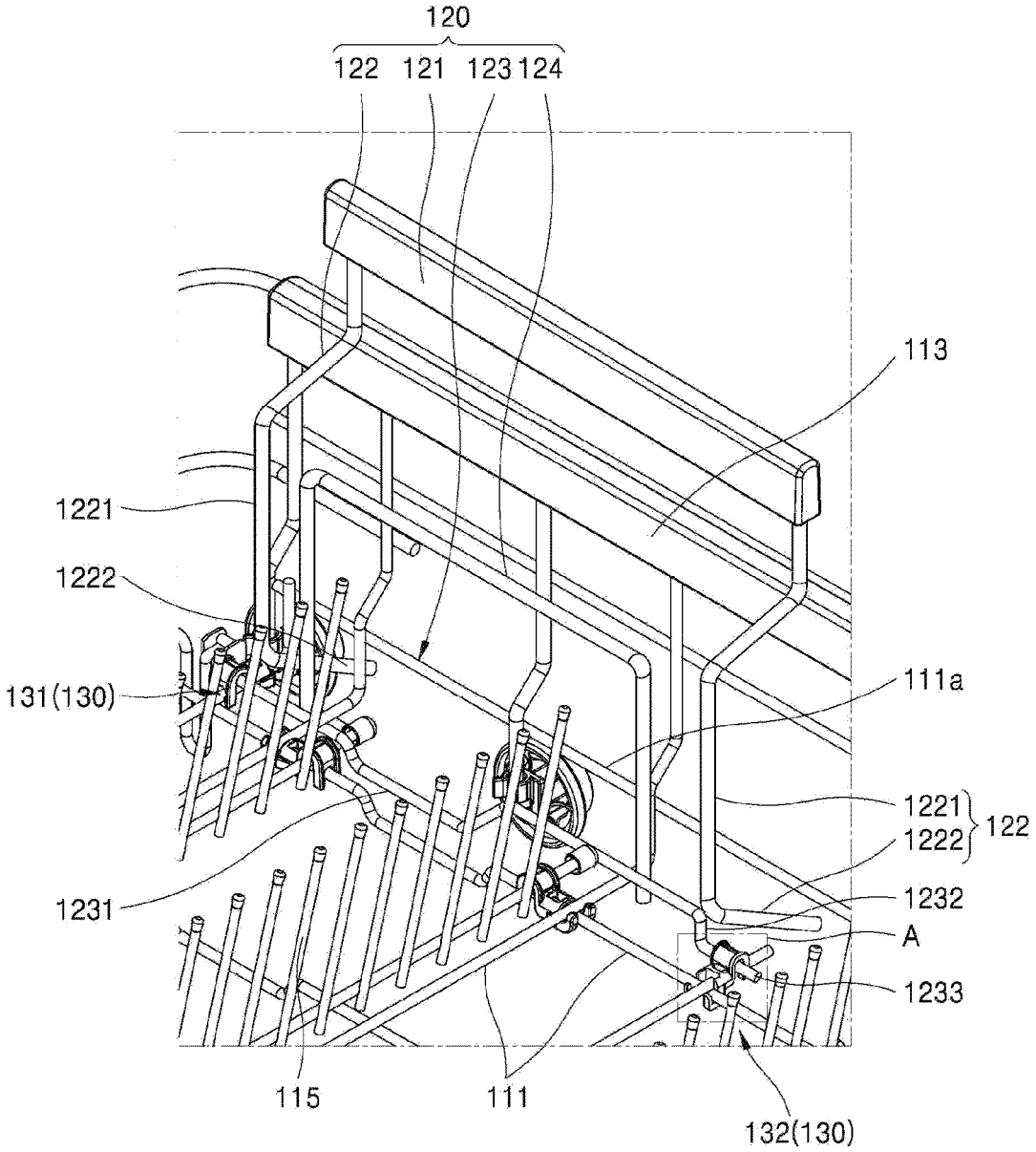
FIG. 5 is a partially enlarged perspective view of a storage rack according to an embodiment.

Referring to FIG. 5 and FIGS. 10A and 10B, the cross arm 123 may include a first piece 1231, a second piece 1232, a third piece 1233 and a fourth piece 1234. The first to fourth pieces 1231 to 1234 may be integrally formed with each other as one body.

Both ends of the first piece 1231 may be coupled to the pair of the side arms 122, respectively. The longitudinal direction of the first piece 1231 may be a direction that is substantially parallel to that of the support bar 121, that is, a first direction.

The second piece 1232 may be provided as a pair, and may be bent at both ends of the first piece 1231. The pair of the second pieces 1232 may be provided in both ends of the first piece 1231, respectively.

The third piece 1233 may be provided as a pair, and may be bent at ends of the pair of the first pieces 1231, respectively. The pair of the third pieces 1233 may be rotatably coupled to the first holder 131 and the second holder 132. One of the pair of the third pieces 1233 may be coupled to the first holder 131 and the other one thereof may be coupled to the second holder 132.

The fourth piece 1234 may be bent from the third piece 1233 coupled to the first holder 131. The fourth piece 1234 may be bent at one third piece 1233 as one body. The fourth piece 1234 may be pressurized by the first holder 131 to support the side rack 120 so that the entire area of the side rack 120 may maintain the first posture ST1 and the second posture ST2.

The first holder 131 may include a first cell 1311, a second cell 1312 and a third cell 1313. The first to third cells 1311 to 1313 may be integrally formed with each other and fabricated by injection-molding as one example.

A plurality of coupling grooves may be formed in the third holder 131 and the wire 111 may be inserted in the coupling groove to couple the first holder 131 to the wire 111. The coupling grooves may include a first coupling groove 131*a*, a second coupling groove 131*b* and a third coupling groove 131*c*.

The first coupling groove 131*a* may be formed in the first cell 1311 in a direction intersecting the direction in which the second coupling groove 131*b* is formed. The second coupling groove 131*b* may be formed to penetrate the first cell 1311 and the second cell 1312, and may be formed in a direction intersecting the direction in which the first coupling groove 131*a* is formed.

The wire may be coupled to the first coupling groove 131*a* and the second coupling groove 131*b*. Accordingly, two wires disposed in the intersecting directions may be provided in the first cell 1311.

The third coupling groove 131*c* may be formed in the second cell 1312 in a direction intersecting the direction in which the second coupling groove 131*b* is formed. The cross arm 123 and the third piece 1233 may be rotatably coupled to the third coupling groove 131*c*.

The first cell 1311 may be coupled to the wire 111. The first cell 1311 may include the first coupling groove 131*a* and the second coupling groove 131*b*, and the wire 111 may be inserted in the first coupling groove 131*a* and the second coupling groove 131*b*, so that the first cell 1311 may be coupled to the wire 111. The first cell may include a 1-1 cell 1311*a* and a 1-2 cell 1311*b*.

The first coupling groove 131*a* may be formed in the 1-1 cell 1311*a*. The 1-1 cell 1311*a* may be coupled to a portion in which the plurality of wires 111 intersect each other. The 1-1 cell 1311*a* may be coupled to the portion in which the wires 111 disposed in the first direction and the second direction cross each other in the longitudinal direction.

The 1-1 cell 1311*a* may be coupled to the portion in which the wires intersect. To maintain the stable coupling with the wire 111, the 1-1 cell 1311*a* may be provided as a pair of hooks spaced apart from each other to form a predetermined space for accommodating the wires.

The second coupling groove 131*b* may be formed in the 1-2 cell 1311*b*. The 1-2 cell 1311*b* may be coupled to the 1-1 cell 13111*a* so that the wires 111 may penetrate them. The 1-1 cell 1311*a* and the 1-2 cell 1311*b* may be firmly coupled to the wires 111 by shape-fitting and forcibly-fitting.

The second cell 1312 may be connected to the first cell 1311 and the third piece 1233 may be rotatably coupled to the second cell. Since the third piece 1233 is rotatable with respect to the second cell 1312, the side rack 120 may be rotatable with respect to the rack 1M.

The third cell 1313 may be connected to the first cell 1311 and the fourth piece 1234 may be rotatably coupled to the third cell 1313. Referring to FIGS. 10A and 10B, the third cell 1313 may include a first guide pin 1313*a*, a second guide pin 1313*b*, a rotation limiter 1313*c* and a damper 1313*d*.

The first guide pin 1313*a* may be configured to guide the rotation of the fourth piece 1234. The second guide pin 1313*b* may be spaced a preset distance apart from the first guide pin 1313*a* to form a rotation space in which the fourth piece 1234 rotates, and may be configured to guide the rotation of the fourth piece 1234. The fourth piece 1234 may be disposed between the first guide pin 1313*a* and the second guide pin 1313*b* to be rotatable between them The rotation limiter 1313*c* may be configured to connect one end of the first guide pin 1313*a* and one end of the second guide pin 1313*b* and limit the rotation of the fourth piece 1234 by becoming into contact with the fourth piece 1234. In a state of being in contact with the rotation limiter 1313*c*, the fourth piece 1234 may be positioned in the maximum rotation range. Accordingly, the fourth piece may not rotate in a range beyond the rotation limiter 1313*c* so the rotation range of the side rack 120 may be limited.

The damper 1313*d* may be protruded from the second guide pin 1313*b* and formed in the rotation space. The damper 1313*d* may be formed in the rotation space formed between the first guide pin 1313*a* and the second guide pin 1313*b*, in which the fourth piece 1234 rotates.

The damper 1313*d* may maintain the current posture of the entire side rack 120 including the fourth piece 1234, that is, the first posture ST1 or the second posture ST2 by pressurizing the fourth piece 1234. In order for the fourth piece 1234 to move through the damper 1313*d* in the rotation space, the user must apply an external force to the side rack 120.

Accordingly, the position and posture of the side rack 120 may be changed from the first posture ST1 to the second posture ST2 by the external force applied by the user. The side rack 120 may maintain the first posture ST1 or the second posture ST2 without being rotated due to the impact applied by the wash water sprayed to the side rack 120 during the washing process.

Figure 6A:
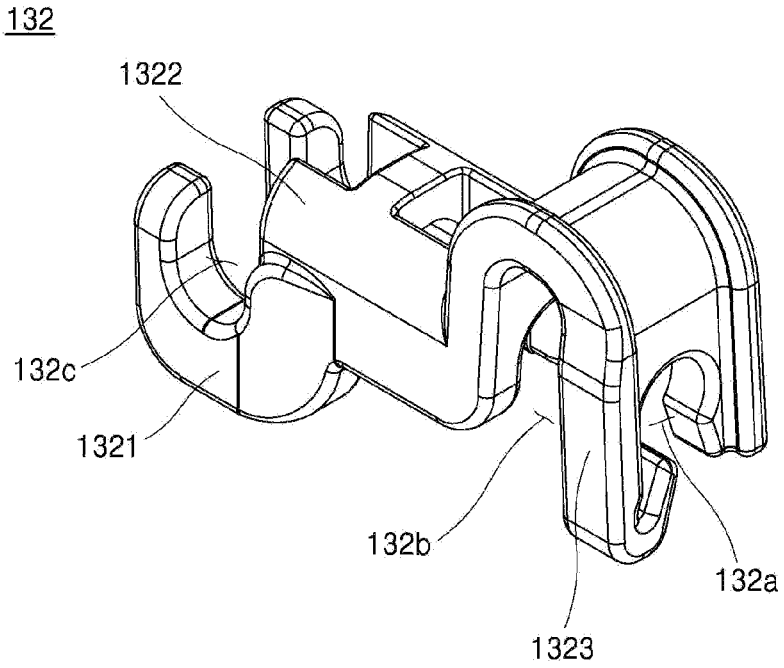
FIG. 6A is a perspective view showing a second holder according to an embodiment.
Figure 6B:
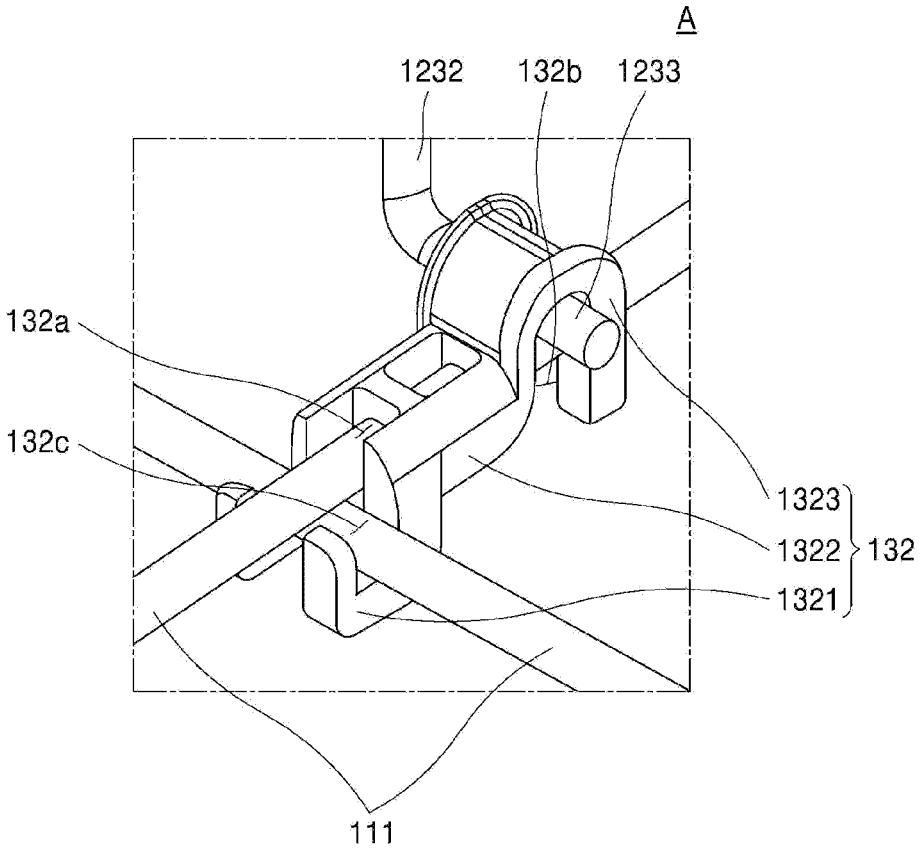
FIG. 6B is an enlarged view of A shown in FIG. 5.

FIG. 6A is a perspective view showing a second holder 132 according to an embodiment. FIG. 6B is an enlarged view of A shown in FIG. 5. Referring to FIGS. 6A and 6B, the second holder 132 may include a first section 1321, a second section 1322 and a third section 1323. The first to third sections 1321 to 1323 may be integrally formed with each other. As one example, they may be fabricated by injection molding.

A plurality of recesses may be formed in the second holder 132 and the wires 111 may be inserted in the recesses to couple the second holder to the wires 111. The recesses may include a first recess 132*a*, a second recess 132*b* and a third recess 132*c*.

The first recess 132*a* may be formed to penetrate the second section 1322 and the third section 1323. The second recess 132*b* may be formed in the third section 1323 in a direction intersecting the direction in which the first recess 132*a* is formed. The wire 111 may be inserted in the first recess 132*a*. The third piece 1233 of the cross arm 123 may be rotatably coupled to the second recess 132*b*.

The third recess 132*c* may be formed in the first section 1321 in a direction intersecting the direction in which the first recess 132*a* is formed. Accordingly, two wires 111 disposed in the intersecting directions may be provided in the first section 1321.

The first section 1321 may be coupled to a portion in which the wires 111 intersect. The first section 1321 may be coupled to a portion in which the wires 111 arranged in the first direction and the second direction, respectively, intersect each other in the longitudinal direction.

The first section 1321 may be easily coupled to the portion in which the wires intersect each other. To maintain the stable coupling with the wires, the first section 1321 may be provided as a pair of hooks spaced a preset distance apart from each other as one example. Since it includes a third recess 132*c*, the first section 1321 may have a hook shape.

The second section 1322 may be coupled to the first section 1321 and penetrated by the wire 111. The first section 1321 and the second section 1322 may be firmly coupled to the wire 111 by shape-fitting and forcible fitting.

The third section 1322 may be coupled to the second section 1322 and the third piece 1233 may be rotatably coupled to the third section 1322. As the third piece 1233 is rotated with respect to the third section 1323, the side rack 120 may be rotated with respect to the rack 100.

Hereinafter, referring to FIGS. 7 to 10B, the first posture ST1 and the second posture ST2 of the side rack 120, and the structure for maintaining the first posture ST1 and the second posture ST2 will be described in detail. At this time, the first posture ST1 and the second posture ST2 may be changeable by the rotation of the side rack 120 with respect to the storage rack 100.

Figure 7:
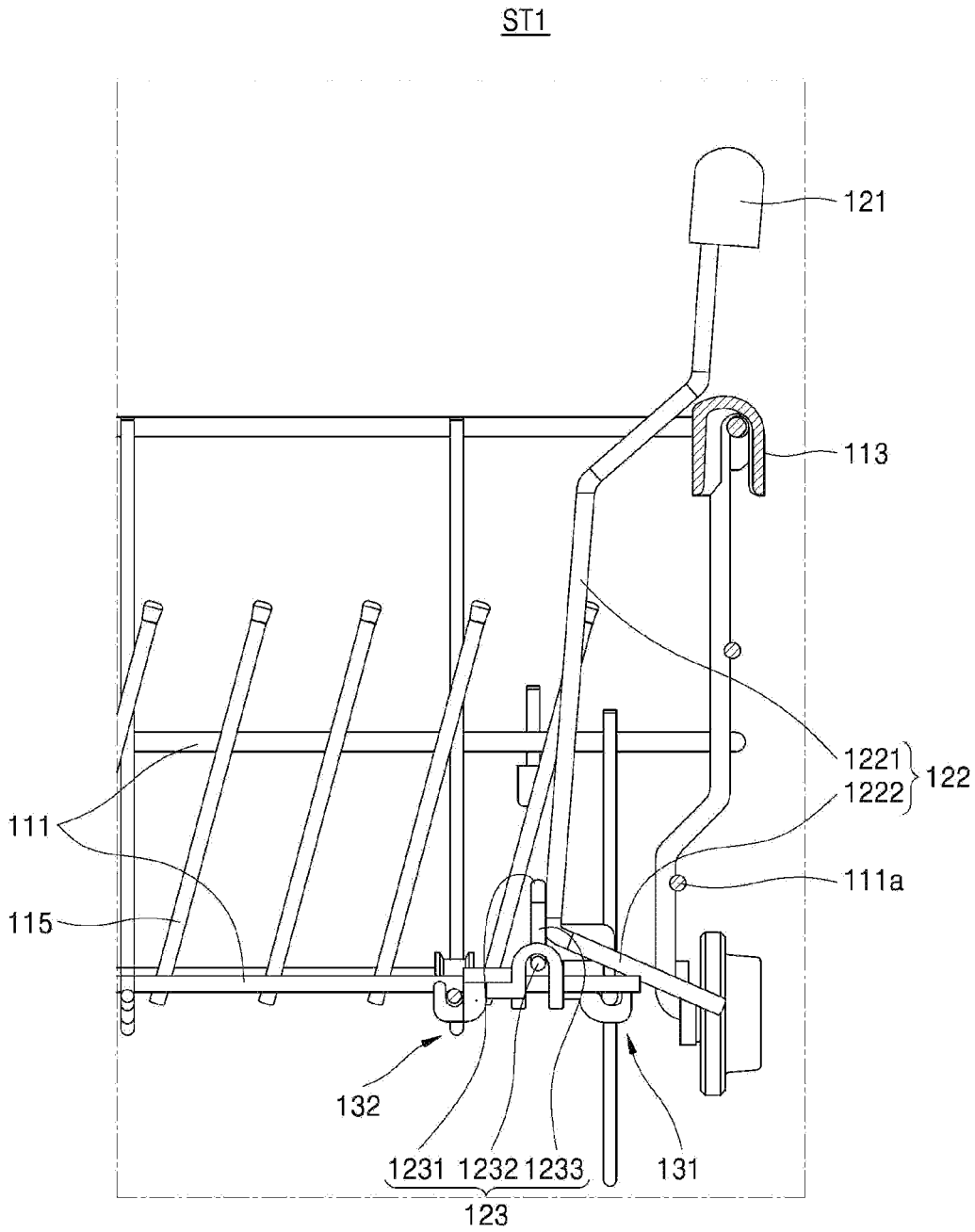
FIG. 7 is a view showing a state where a side rack according to an embodiment maintains a first posture.

FIG. 7 is a view showing a state where the side rack 120 according to the embodiment maintains the first posture. Referring to FIGS. 7 and 10B, the first posture ST1 will be described in detail.

As shown in FIG. 7, the first posture ST1 is a posture taken by the side rack 120 when the side rack 120 is not used to store dishes. Accordingly, the support bar 121 of the side rack 120 taking the first posture ST1 may be located in the edge of the rack 100.

In the first posture ST1, the support bar 121 may be located adjacent to the rib 113. For example, the support bar 121 may be overlapped with at least certain area of the rib 113 in a vertical direction of the storage rack 100.

Specifically, in the first posture ST1, the side rack 120 may be moved to the edge of the rack 100 as much as possible and interference with the plurality of tines 115 provided in the rack 100 may be reduced as much as possible. Accordingly, in the first posture ST1, the side rack 120 may be prevented from interfering with the tines 115 as much as possible so that many dishes can be mounted on the plurality of tines 115, thereby increasing the storage efficiency in the tines 115.

When the fourth piece 1234 is disposed in a first space 1313-1 defined between the rotation limiter 1313*c* and the damper 1313*d*, the side rack 120 may maintain a first posture having a preset inclined angle with respect to the frame 110.

At this time, the inclined angle of the side rack 120 with respect to the frame 110 in the first posture ST1 may be selected in consideration of the overall shape of the side rack 120, the degree of the interference between the tines 115 fixed to the rack 100 and the side rack 120, etc.

In the first posture ST1, the fourth piece 1234 may be disposed in the first space 1313-1 and pressurized by the rotation limiter 1313*c* and the damper 1313*d*. Accordingly, the fourth piece 1234 may be tightly fitted between the rotation limiter 1313*c* and the damper 1313*d*.

Due to such the structure, the side rack 120 in the first posture ST1 may be suppressed from shaking or moving by a relatively small external shock. In this instance, the moving means that the side rack 120 rotates a certain angle with respect to the holder 130. The shaking means that the side rack 120 vibrates by an external shock.

Accordingly, even when the washing is performed in the first posture ST1, the sprayed wash water may be effectively suppressed from shaking or moving by the external shock applied to the side rack 120 by the wash water.

Figure 8:
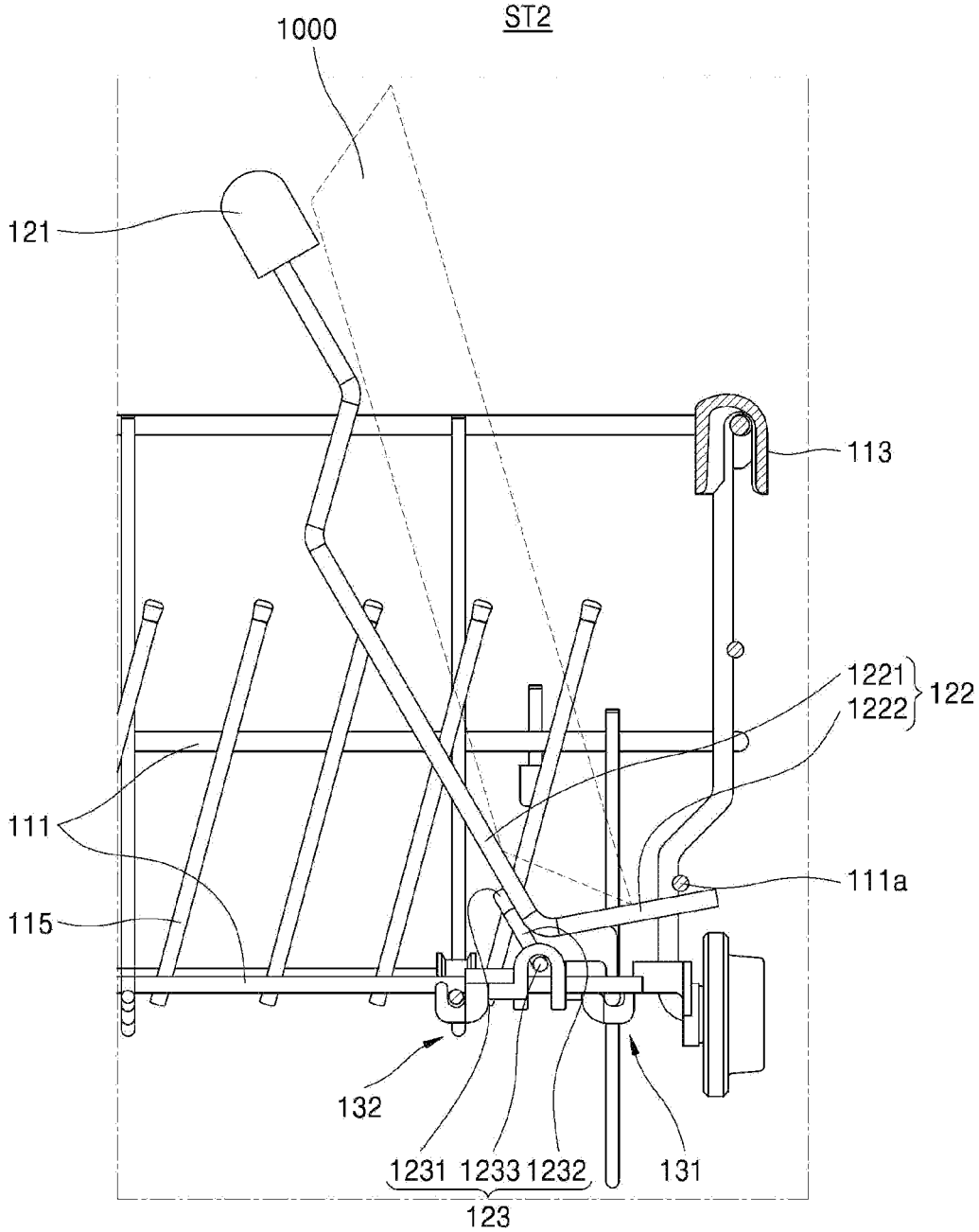
FIG. 8 is a view showing a state where a side rack according to an embodiment maintains a second posture.
Figure 9:
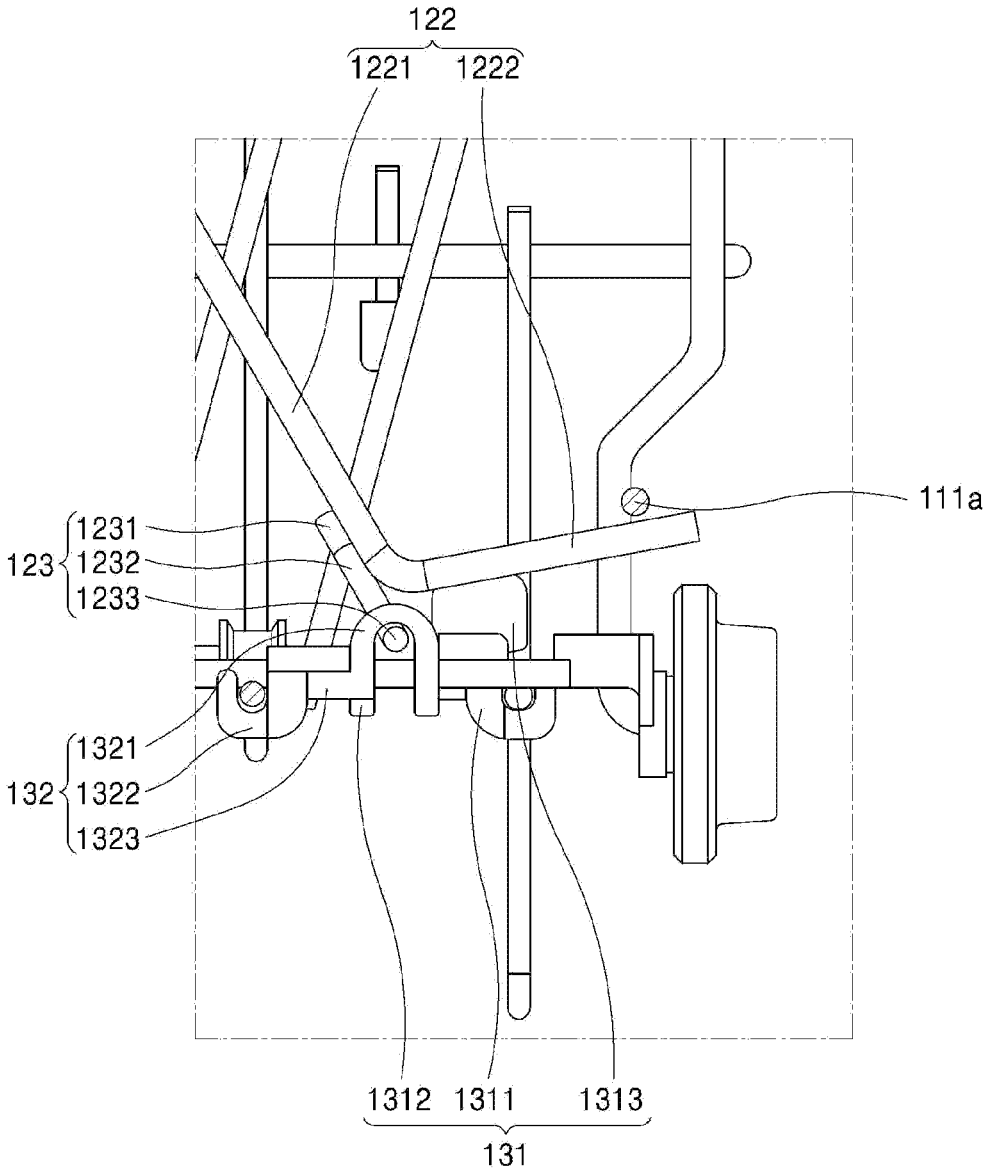
FIG. 9 is a partially enlarged view of FIG. 8.

Hereinafter, referring to FIGS. 8 to 10B, the second posture ST2 will be described in detail. FIG. 8 is a view showing a state where the side rack 120 according to the embodiment maintains a second posture. FIG. 9 is a partially enlarged view of FIG. 8.

The second posture ST2 is a posture taken by the side rack 120 when the side rack 120 is used to store dishes. Accordingly, in the second posture ST2, the support bar 121 of the side rack 120 may be located far more distant from the edge of the rack 100 in comparison to the first posture ST1.

Since it rotates with respect to the storage rack 100, the posture of the side rack 120 may be changed from the first posture ST1 to the second posture ST2 or vice versa. The user may change the posture of the side rack 120 to the first posture ST1 or the second posture ST2 by applying an external impact to the support bar 121.

In the second posture ST2, the support bar 121 may be located relatively far distant from the rib 113. At this time, relatively large-sized tableware (e.g., a dish 1000) may be stored in a space formed between the support bar 121 and the rib 113 at a preset inclined angle with respect to the frame 110. The stored dish 1000 may be supported by the support bar 121, the second part 1222 of the side arm 122 and the auxiliary support portion 124, and then stored in the storage rack 100.

When the fourth piece 1234 is separated from the first space 1313-1 and the rotation of the second part 1222 is limited by the stopper 111*a*, the side rack 120 may maintain the second posture ST2 having a preset inclined angle with respect to the frame 110.

When the user rotates the side rack in the first posture ST1 by applying an external impact, the fourth piece 1234 may be separated from the first space 1313-1 and the side rack 120 may be rotated with respect to the rack 100.

At this time, the side rack 120 may be rotated until the second part 1222 of the side arm 122 becomes into contact with the stopper 111*a*. When the second part 1222 becomes in contact with the stopper 111*a*, the side rack 120 may take the second posture STS2.

The inclined angle of the side rack 120 taking the second posture ST2 with respect to the storage rack 100 may be properly selected in consideration of the space required to use the side rack in the storage rack 100, the volume and shape of the dish stored in the side rack 120.

The external force applied to the side rack 120 may elastically deform at least one of the fourth piece 1234 or the third cell 1313, so that the side rack 120 may be rotated to reach a new position from the current position.

When the user applies an external force, at least one of the fourth piece 1234 or the third cell 1313 may be elastically deformed by the external force so that the fourth piece 1234 may be rotated through the damper 1313*d*. In this way, the posture of the side rack 120 may be changed from the first posture ST1 to the second posture ST2 or vice versa by the external force applied by user to change the posture of the side rack 120.

As shown in FIG. 9, when the side rack 120 maintains the second posture ST2, the fourth piece 1234 may be in contact with the damper 1313*d* and the second part 1222 may in contact with the stopper 111*a*.

The damper 1313*d* may be in contact with the fourth piece 1234 at difference portions in the first posture ST1 and the second posture ST2, respectively. In the second posture ST2, the damper 1313*d* may pressurize the fourth piece 1234 and the stopper 111*a* may pressurize the second part 1222.

That is, in the second posture ST2, the damper 1313*d* may stop the fourth piece 1234 from moving toward the first posture ST1 without an external force sufficient to overcome the elastic force of the third cell 1313, and the stopper 111*a* may stop the second part 1222 from being more inclined by the gravity or external force, thereby maintaining the preset inclined angle. In the first posture ST1, the damper 1313*d* may stop the fourth piece 1234 from moving toward the second posture ST2 without an external force sufficient to overcome the elastic force of the third cell 1313.

Accordingly, the side rack 120 including the fourth piece 1234 and the second part 1222 may be pressurized by the damper 1313*d* and the stopper 111*a*, thereby maintaining the tight state. That is, the side rack k120 may be in the tight state even in the second posture ST2.

Due to this structure, the side rack 120 in the second posture ST2 may be suppressed from shaking or moving by a relatively small external force.

Accordingly, even in the second posture ST2 like the first posture ST1, the side rack 120 may be effectively suppressed from shaking or moving by the external impact applied to the side rack 120 by the wash water sprayed in the washing process.

In the embodiment, the side rack 120 may tightly maintain the first posture ST1 or the second posture ST2 even with the impact applied by the wash water sprayed in the washing process.

In the embodiment, unless the user applies a relatively large external force to the side rack 120, the side rack 120 may maintain the first posture ST1 or the second posture ST2. The posture of the side rack 120 may not be changed by the wash water sprayed during the washing process.

Accordingly, the side rack 120 may be suppressed from moving or shaking by the wash water sprayed during the washing process. Accordingly, damage to dishes and noise caused by the moving and shaking of the side rack 120 may be effectively suppressed, thereby increasing user convenience and improving the performance of the dishwasher 1.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A dishwasher comprising:

a storage rack, wherein the storage rack comprises:

a frame configured to receive a washing target, a side rack configured to rotate with respect to the frame and support the washing target, and a holder coupled to the frame and configured to guide a rotation of the side rack, wherein the side rack comprises:

a support bar extending in a first direction and configured to support the washing target, a pair of side arms coupled to opposite ends of the support bar, respectively, and a cross arm coupled to the support bar, opposite ends of the cross arm being coupled to the holder to enable the cross arm to rotate with respect to the holder, wherein the holder comprises:

a first holder coupling one of the opposite ends of the cross arm to enable the cross arm to rotate with respect to the holder, the first holder being configured to maintain the side rack to be inclined at a preset angle with respect to the holder, and a second holder spaced from the first holder in the first direction and coupling the other of the opposite ends of the cross arm to enable the cross arm to rotate with respect to the holder, wherein the cross arm comprises:

a pair of first pieces being rotatably coupled to the first holder and the second holder, respectively, and a second piece extending at an angle from the pair of first pieces coupled to the first holder, and wherein the first holder comprises:

a first cell configured to engage the frame, a second cell coupled to the first cell and configured to rotatably engage the pair of first pieces, and a third cell coupled to the first cell and configured to rotatably engage the second piece.

2. The dishwasher of claim 1, wherein the support bar is configured to, based on the pair of side arms rotating, rotate along with the pair of side arms, and wherein the support bar is configured to move in a second direction intersecting the first direction.

3. The dishwasher of claim 1, wherein the preset angle includes a plurality of angles predetermined to maintain the side rack in a plurality of postures with respect to the holder.

4. The dishwasher of claim 1, wherein each of the pair of side arms comprises:

a first part having an end coupled to the support bar, and a second part curved at an opposite end of the first part.

5. The dishwasher of claim 4, wherein the frame comprises a mesh defined by a plurality of wires intersecting each other, and wherein the side rack is configured to be limited to rotate based on the second part coming to contact a stopper, the stopper being one of the plurality of wires.

6. The dishwasher of claim 5, wherein the cross arm comprises:

a third piece having opposite ends that are coupled to the pair of side arms, respectively; and a pair of fourth pieces extending at an angle from opposite ends of the third piece.

7. The dishwasher of claim 5, wherein the first cell comprises:

a first sub-cell configured to be positioned at an intersection of the plurality of wires; and a second sub-cell coupled to the first sub-cell, wherein the plurality of wires extend through the second sub-cell.

8. The dishwasher of claim 1, wherein the third cell comprises:

a first guide pin configured to guide rotation of the second piece;

a second guide pin spaced apart from the first guide pin and defining a rotation space that accommodates the rotation of the second piece, the second guide pin being configured to guide the rotation of the second piece;

a rotation limiter configured to connect the first guide pin to the second guide pin and limit the rotation of the second piece by contacting the second piece; and a damper protruding from the second guide pin and provided at the rotation space.

9. The dishwasher of claim 8, wherein when the second piece is disposed at a first space defined between the rotation limiter and the damper, the side rack being configured to maintain a first posture having a preset angle with respect to the frame.

10. The dishwasher of claim 9, wherein each of the pair of side arms comprises:

a first part having an end coupled to the support bar, and a second part curved at an opposite end of the first part, wherein the frame comprises a mesh defined by a plurality of wires intersecting each other, wherein the side rack is configured to be limited to rotate based on the second part coming to contact a stopper, the stopper being one of the plurality of wires, and wherein the side rack is configured to, based on the second piece being separated from the first space and rotation of the second part being limited by the stopper, maintain a second posture having a preset angle with respect to the frame.

11. The dishwasher of claim 10, wherein, based on the side rack maintaining the second posture, the second piece is configured to contact the damper and the second part is configured to contact the stopper.

12. The dishwasher of claim 10, wherein at least one of the second piece or the third cell is configured to be deformed by an external force applied to the side rack and rotate the side rack.

13. The dishwasher of claim 6, wherein the second holder comprises:

a first section configured to be positioned at an intersection of the plurality of wires;

a second section coupled to the first section, wherein the plurality of wires extend through the second section; and a third section coupled to the second section and rotatably coupling any one of the pair of first pieces.

14. The dishwasher of claim 1, wherein the frame is configured to, based on being mounted to the dishwasher, include a handle provided adjacent to a door, the door being configured to open and close a washing space of the dishwasher, wherein the side rack is disposed adjacent to one side of the handle and an edge of the frame, and wherein a length of the side rack intersects a length of the handle.

15. A dishwasher storage rack comprising:

a frame configured to receive a washing target in a dishwasher;

a side rack configured to rotate with respect to the frame and support the washing target; and a holder coupled to the frame and configured to guide a rotation of the side rack, wherein the side rack comprises:

a support bar extending in a first direction and configured to support the washing target, a pair of side arms coupled to opposite ends of the support bar, respectively, and a cross arm coupled to the support bar, opposite ends of the cross arm being coupled to the holder to enable the cross arm to rotate with respect to the holder, wherein the holder comprises:

a first holder coupling one of the opposite ends of the cross arm to enable the cross arm to rotate with respect to the holder, the first holder being configured to maintain the side rack to be inclined at a preset angle with respect to the holder, and a second holder spaced from the first holder in the first direction and coupling the other of the opposite ends of the cross arm to enable the cross arm to rotate with respect to the holder, wherein the cross arm comprises:

a pair of first pieces being rotatably coupled to the first holder and the second holder, respectively, and a second piece extending at an angle from the pair of first pieces coupled to the first holder, and wherein the first holder comprises:

a first cell configured to engage the frame, a second cell coupled to the first cell and configured to rotatably engage the pair of first pieces, and a third cell coupled to the first cell and configured to rotatably engage the second piece.

16. The dishwasher storage rack of claim 15, wherein the support bar is configured to, based on the pair of side arms rotating, rotate along with the pair of side arms, and wherein the support bar is configured to move in a second direction intersecting the first direction.

* * * * *